US005114375A

United States Patent [19]

Wellhausen et al.

[11] Patent Number: 5,114,375

[45] Date of Patent: May 19, 1992

[54] TOY APPARATUS

[76] Inventors: Brenda L. Wellhausen; James R. Wellhausen, both of 10310 Coakley Rd., Logan, Ohio 43138

[21] Appl. No.: 723,776

[22] Filed: Jul. 1, 1991

[51] Int. Cl.[5] ..... A63H 33/00

[52] U.S. Cl. ..... 446/246; 446/267; 446/475; 366/245

[58] Field of Search ..... 446/267, 246, 236, 479, 446/475; 366/245, 244, 297

[56] References Cited

U.S. PATENT DOCUMENTS

| | | | |
|---|---|---|---|
| 430,783 | 6/1890 | Mulford | 366/245 |
| 913,398 | 2/1909 | Kier | 366/245 |
| 1,612,281 | 12/1926 | Goetz | 366/244 |
| 3,171,636 | 3/1965 | Barlow et al. | 446/479 X |

OTHER PUBLICATIONS

"Lil' Floor Polisher" Kusan Toycraft Catalog 1966.

*Primary Examiner*—Mickey Yu

[57] ABSTRACT

An apparatus wherein a lid is mounted to an underlying container, with a fluid positioned within the container. A crank handle is rotatably mounted relative to the lid to rotate a crank handle gear, in turn rotating a matrix of driven gears, each driven gear including an output shaft of varying length projecting interiorly of the container. Each output shaft arranged in a parallel relationship including a paddle blade at a lower terminal end thereof of a varying configuration to effect agitation of the fluid for novelty and amusement of an individual. The blades and gears are typically formed of contracting colorations. A modification of the invention includes the gears formed with hollow chambers, and each hollow chamber including a centrifugal valve operative upon rotation of the gears to direct a fluid dye into the fluid of the container to enhance amusement and enjoyment of the organization.

4 Claims, 4 Drawing Sheets

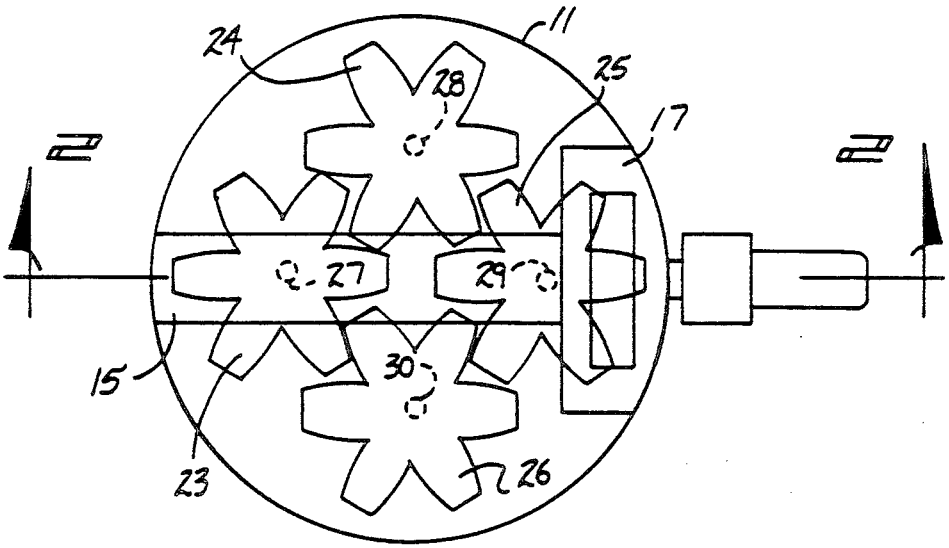
Fig 1
Fig 2
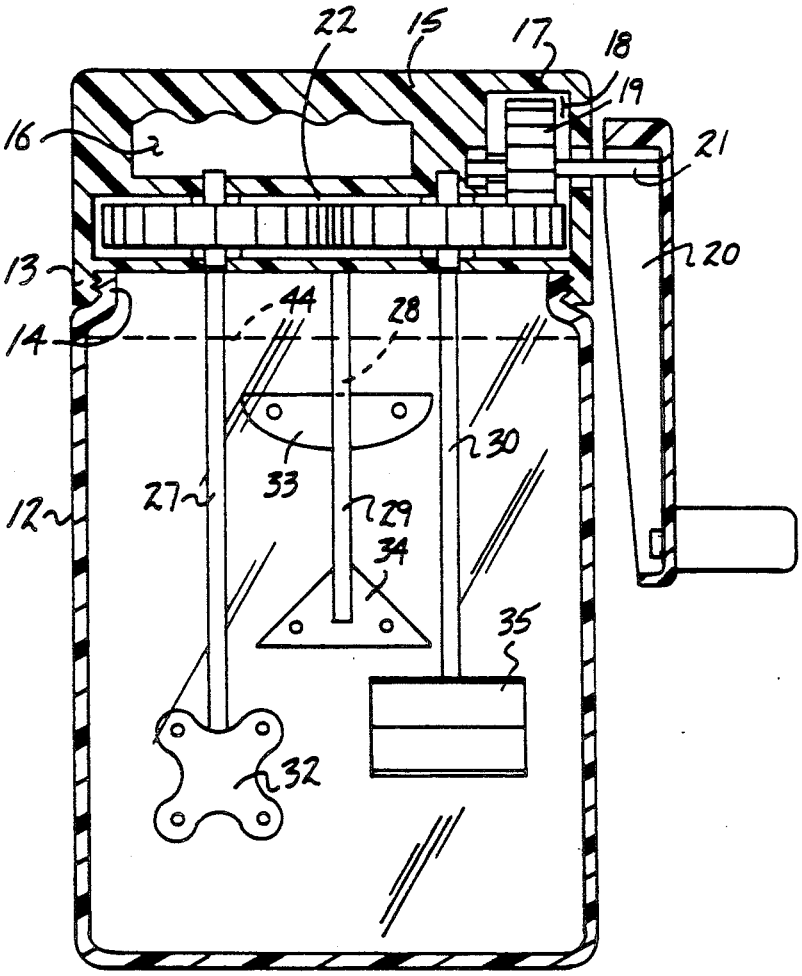

TOY APPARATUS

BACKGROUND OF THE INVENTION

1. Field of the Invention

The field of invention relates to apparatus for amusement by children, and more particularly pertains to a new and improved toy apparatus wherein the same is directed for amusement and entertainment of children and the like.

2. Description of the Prior Art

Toy apparatus for amusement and enjoyment is available in the prior art as are various structural apparatus providing stirring apparatus and the like projecting stirring devices within a fluid. Such stirring devices typically utilize equal length rods mounting paddle wheels and the like at lower terminal ends thereof, such as typified in U.S. Pat. No. 4,429,624 to Linn wherein a stirring arrangement utilizes a plurality of stirring members mounted at lower ends of a shaft that are simultaneously rotated.

U.S. Pat. No. 1,844,691 to Schneider, et al. sets forth a vegetable cleaner and the like utilizing central shaft employing a plurality of stirring members projecting exteriorly thereof.

U.S. Pat. No. 3,285,184 to Goldfarb sets forth a child's drinking tumbler wherein a crank handle effects stirring of a central shaft and blades mounted at a lower terminal end thereof.

As such, it may be appreciated that there continues to be a need for a new and improved toy apparatus as set forth by the instant invention which addresses both the problems of ease of use as well as effectiveness in construction in directing amusement and entertainment of children and the like and in this respect, the present invention substantially fulfills this need.

SUMMARY OF THE INVENTION

In view of the foregoing disadvantages inherent in the known types of toy apparatus now present in the prior art, the present invention provides a toy apparatus wherein the same effects simultaneous stirring of a plurality of paddles within a fluid for enhancement and amusement of children. As such, the general purpose of the present invention, which will be described subsequently in greater detail, is to provide a new and improved toy apparatus which has all the advantages of the prior art toy apparatus and none of the disadvantages.

To attain this, the present invention provides an apparatus wherein a lid is mounted to an underlying container, with a fluid positioned within the container. A crank handle is rotatably mounted relative to the lid to rotate a crank handle gear, in turn rotating a matrix of driven gears, each driven gear including an output shaft of varying length projecting interiorly of the container. Each output shaft arranged in a parallel relationship, including a paddle blade at a lower terminal end thereof of a varying configuration to effect agitation of the fluid for novelty and amusement of an individual. The blades and gears are typically formed of contrasting colorations. A modification of the invention includes the gears formed with hollow chambers, and each hollow chamber including a centrifual valve operative upon rotation of the gears to direct a fluid dye into the fluid of the container to enhance amusement and enjoyment of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application which is measured by the claims, nor is it intended to be limiting as to the scope to the invention in any way.

It is therefore an object of the present invention to provide a new and improved toy apparatus which has all the advantages of the prior art toy apparatus and none of the disadvantages.

It is another object of the present invention to provide a new and improved toy apparatus which may be easily and efficiently manufactured and marketed.

It is a further object of the present invention to provide a new and improved toy apparatus which is of a durable and reliable construction.

An even further object of the present invention is to provide a new and improved toy apparatus which is susceptible of a low cost of manufacture with regard to both materials and labor, and which accordingly is then susceptible of low prices of sale to the consuming public, thereby making such toy apparatus economically available to the buying public.

Still yet another object of the present invention is to provide a new and improved toy apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic top view of the instant invention.

FIG. 2 is an orthographic view, taken along the lines 2—2 of FIG. 1 in the direction indicated by the arrows.

DESCRIPTION OF THE PREFERRED EMBODIMENT

Figure 3:
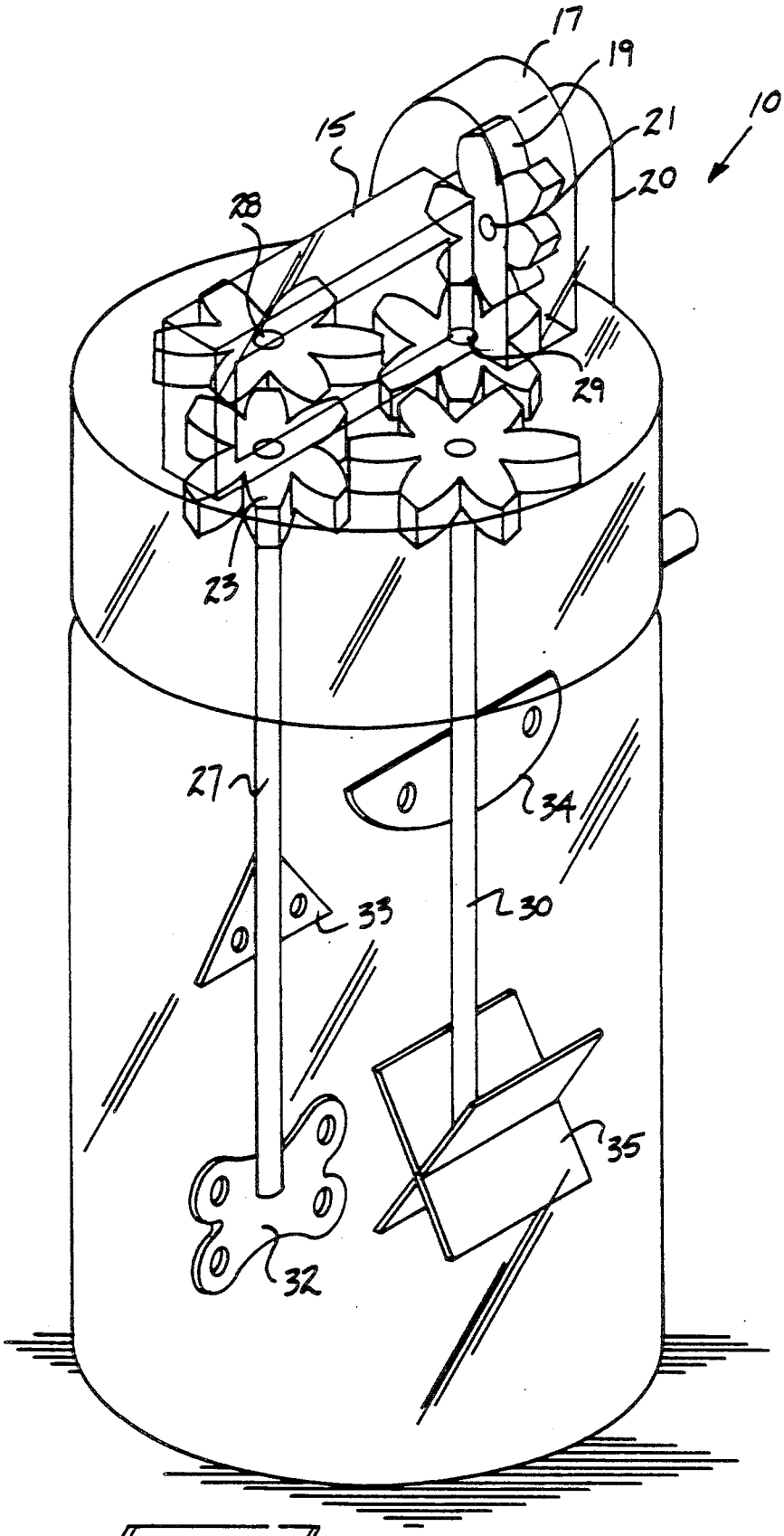
FIG. 3 is an isometric illustration of the instant invention.

With reference now to the drawings, and in particular to FIGS. 1 to 6 thereof, a new and improved toy apparatus embodying the principles and concepts of the present invention and generally designated by the reference numeral 10 will be described.

More specifically, the toy apparatus 10 of the instant invention essentially comprises a transparent lid 11 selectively securable to an upper terminal end of a transparent container 12. The lid 11 includes an internally threaded cylindrical skirt 13 for securement to an externally threaded upper end portion of the container 14. A central lid flange 15 is diametrically directed and fixedly mounted to a top surface of the lid 11, including a handle opening 16 therethrough. A crank handle flange 17 is mounted at a first end of the lid flange 15 in an orthogonal relationship to include a crank handle flange gear cavity 18 contained therewithin. A crank gear 19 is rotatably mounted within the flange gear cavity 18 rotatable about a crank handle axis 21 that in turn is rotated by a crank handle 20. A gear cavity 22 is formed within the lid 15 between the lid flange 15 and the skirt 13 to contain a matrix of gears to include a first, second, third, and fourth gear member 23, 24, 25, and 26 respectively Each gear includes a respective first, second, third, and fourth gear output shaft 27, 28, 29, and 30 orthogonally and coaxially mounted relative to each respective gear projecting interiorly cf the container 12 and projecting from the gear cavity 22. Each gear output shaft is of a varying length defined by a respective first, second, third, and fourth length of the respective first, second, third, and fourth gear. This permits visual observation of a respective first, second, third, and fourth paddle blade 32, 33, 34, and 35 respectively mounted fixedly to each lower terminal end of each respective first through fourth gear member. Each paddle blade is of a contrasting coloration relative to an adjacent paddle blade and may include apertures directed therethrough to enhance agitation and stirring of the container fluid 44 within the container 12.

In this manner, rotation of the crank handle 20 effects simultaneous rotation of each paddle blade and the stirring of the contrasting colorations of paddle blades effects for a visual effect to amuse and entertain a child and the like.

Figure 4:
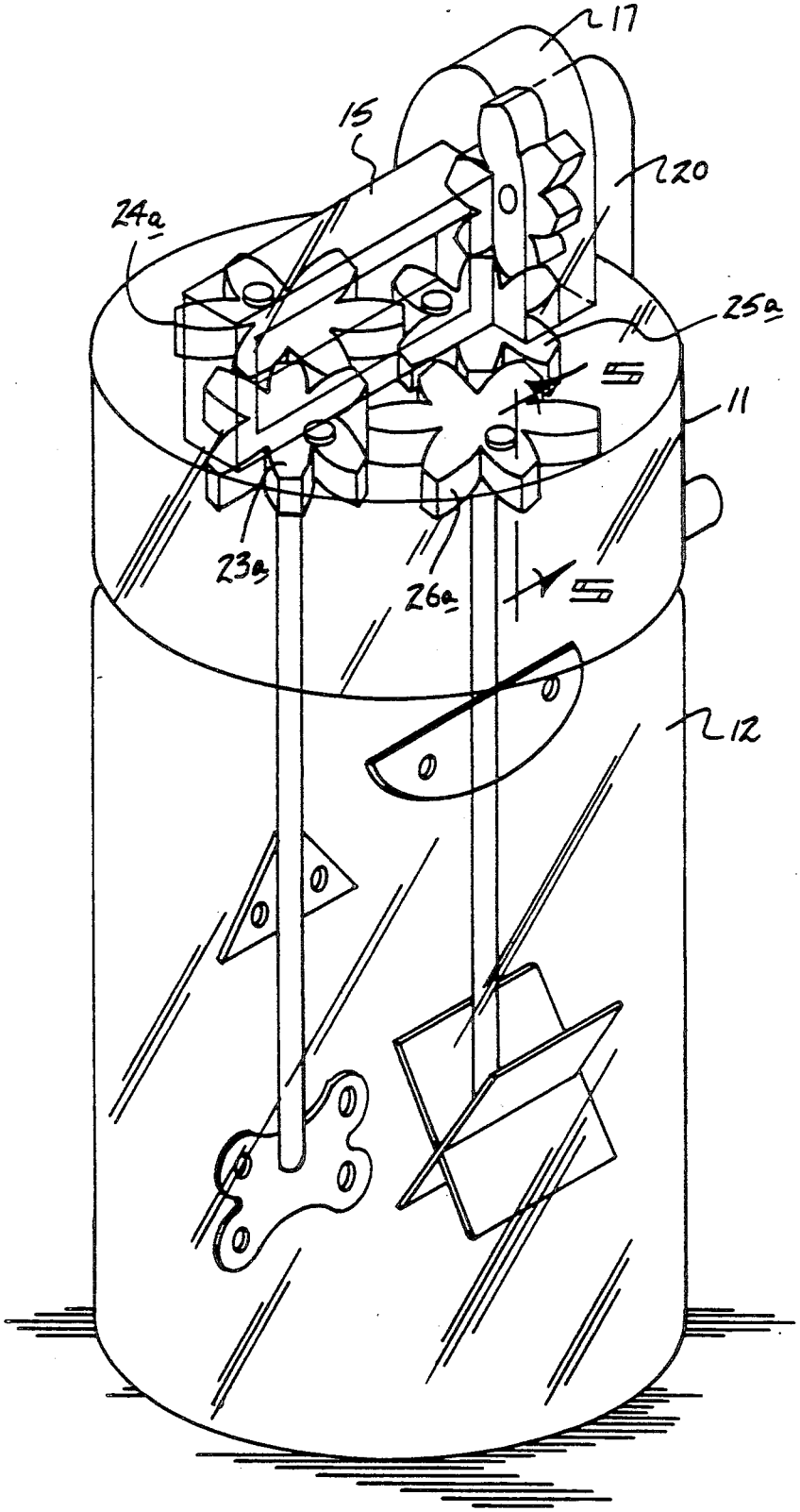
FIG. 4 is an isometric illustration of a modification of the invention.
Figure 5:
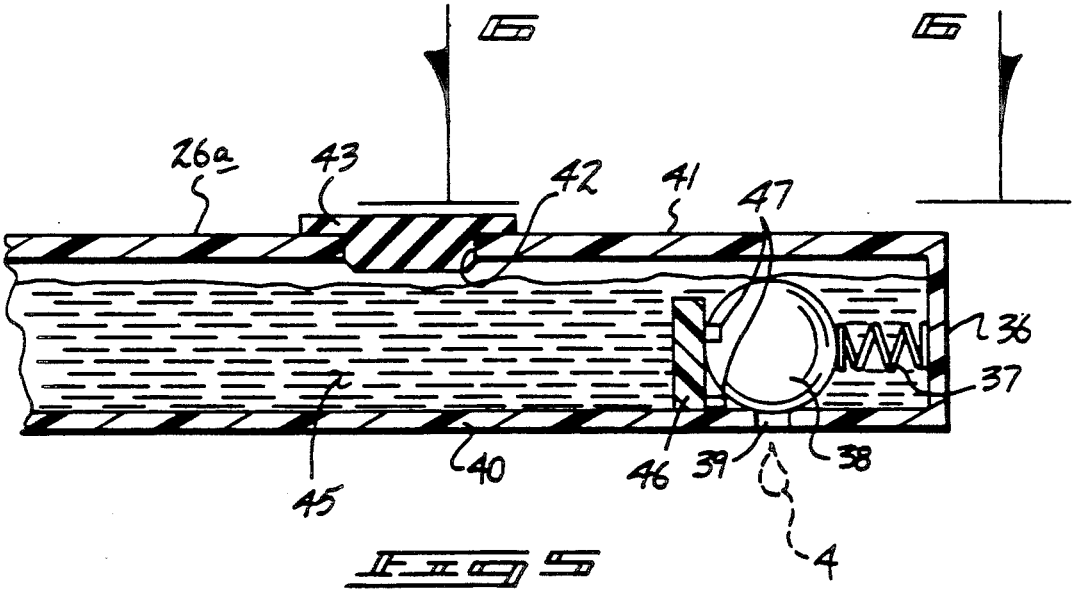
FIG. 5 is an orthographic view, taken along the lines 5—5 of FIG. 4 in the direction indicated by the arrows.
Figure 6:
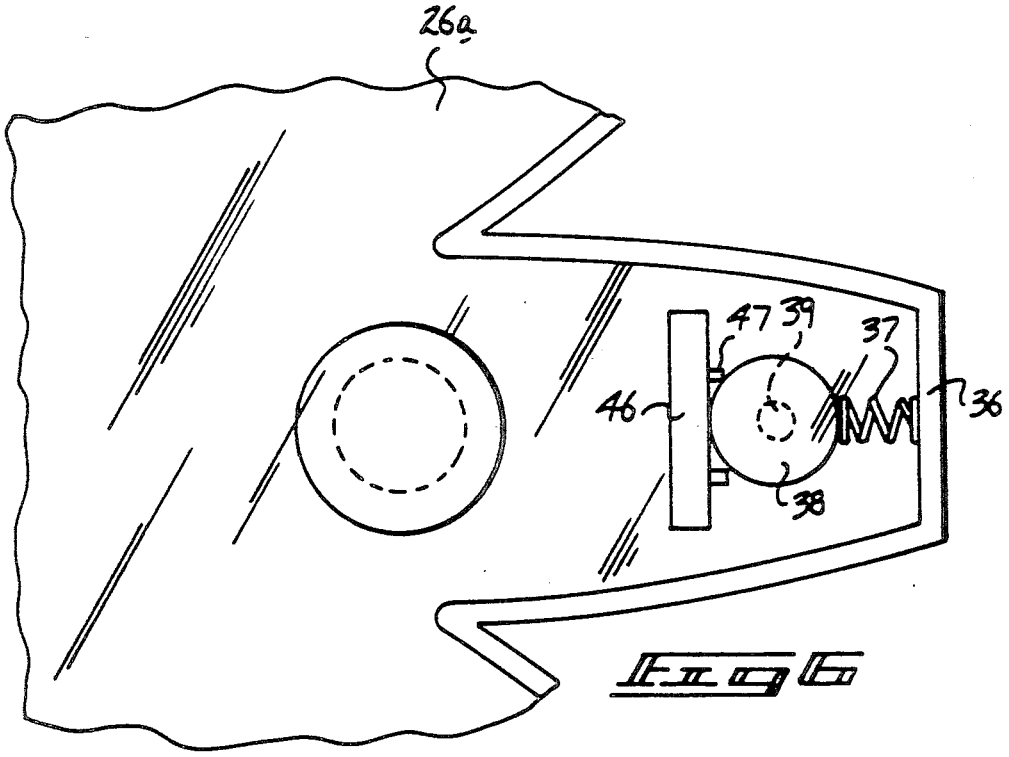
FIG. 6 is an orthographic view, taken along the lines 6—6 of FIG. 5 in the direction indicated by the arrows.

FIGS. 4, 5, and 6 illustrate a modified gear member structure, wherein each of the first through fourth gears are defined as modified first through fourth gears 23*a*, 24*a*, 25*a*, and 26*a*. Each of the gears are of an identical configuration and for purposes of illustration, the fourth modified gear member is illustrated in FIGS. 5 and 6 in detail. Each modified gear includes a gear tooth end wall 36, with a gear bottom wall and a gear top wall defining the hollow gear construction defining an internal reservoir containing a fluid dye 45. Each of the fluid dyes of each of the respective first through fourth gears are desirably of a contrasting coloration. To project metered gear dye from each gear, a spring member 37 is fixedly mounted to an interior surface of the gear toothed end wall 36 mounting a spherical valve 38 at a free terminal end thereof spaced from the gear toothed end wall 36. Each spherical valve 38 is in a first position overlying an opening 39 to prevent fluid flow therethrough. The spherical valve 38 is maintained in position in abutment against an abutment plate 46 including aligned legs 47, with pairs of such aligned legs 47 positioned in a spaced relationship to receive the spherical valve 38 therebetween. A gear top wall opening 42 includes a removable plug member 43 to permit replenishment of the fluid dye 45 within the reservoir defined by each hollow gear. Upon rotation of the gears, the spherical valve 38 by centrifugal force is displaced relative to the opening 39 permitting a metered quantity of fluid dye 45 to flow therethrough into the underlying container fluid 44 to provide for an amusing and entertaining mixture during the stirring procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toy apparatus, comprising in combination, a transparent container, including a container upper end portion, with a transparent lid, the transparent lid selectively securable to the container upper end portion, and the transparent lid including a lid top surface, the lid top surface including a crank handle flange fixedly mounted to the lid top surface adjacent a side wall thereof, and the crank handle flange including a gear cavity therewithin, the gear cavity including a crank gear rotatably mounted within the gear cavity, and a crank handle axle fixedly mounted to the crank gear, with the crank handle axle rotatably mounted to the crank handle flange and the crank handle axle fixedly mounted to a crank handle wherein the crank handle is rotatably mounted relative to the crank handle flange to effect rotation of the crank gear, and a matrix of gear members mounted within the transparent lid, and a gear lid cavity formed within the transparent lid containing the gear members therewithin, and the gear members are orthogonally oriented relative to the crank gear, and each of the gear members in inter-meshing communication relative to one another and at least one of the gear members in inter-meshing communication with the crank gear to effect rotation of the gear members upon rotation of the crank gear, and each gear member including an output shaft coaxially and fixedly mounted to each gear member, with each output shaft projecting into the container, and each output shaft including a paddle blade mounted at a lower terminal end of each output shaft;

and each output shaft of each gear member is of a varying predetermined length, and each paddle blade is of a varying contrasting configuration, and a plurality of paddle blades include apertures directed therethrough, and each of the output shafts are parallel relative to one another, and each gear member is hollow and defines a reservoir therewithin, and each gear member contains a fluid dye therewithin, and valve means mounted within at least one of the gear members to effect selective flow of the fluid dye into the container.

2. An apparatus as set forth in claim 1 wherein the valve means includes a spring member, and each gear member includes a gear tooth and each gear tooth includes an end wall, the spring member mounted fixedly and orthogonally to an interior surface of at least one of the end walls, and a spherical valve mounted to the spring member remote from the end wall, and a bottom wall opening positioned in alignment below the spherical valve, and an abutment plate fixedly mounted within the gear member to a gear member bottom wall to align the spherical valve relative to the bottom wall opening, wherein rotation of the crank gear effects displacement of the spherical valve relative to the bottom wall opening.

3. An apparatus as set forth in claim 2 including a gear top wall positioned over the gear bottom wall, and the gear top wall includes a gear top wall opening, and a plug member selectively mounted within the gear top wall opening to permit replenishment of fluid dye within the reservoir.

4. An apparatus as set forth in claim 3 wherein the abutment plate includes a plurality of alignment legs positioned on opposed sides of the spherical valve to align the spherical valve relative to the abutment plate and the bottom wall opening.

* * * * *